United States Patent [19]

Oishi

[11] 4,129,071

[45] Dec. 12, 1978

[54] ANTI-OVERRUN DEVICE FOR THE SLIDE IN A PRESS

[75] Inventor: Yoshihiro Oishi, Sagamihara, Japan

[73] Assignee: Aida Engineering, Ltd., Kanagawa, Japan

[21] Appl. No.: 757,889

[22] Filed: Jan. 10, 1977

[30] Foreign Application Priority Data

Mar. 8, 1976 [JP] Japan ..... 51/90215

[51] Int. Cl.[2] ..... B30B 1/26; B30B 15/14

[52] U.S. Cl. ..... 100/53; 192/149

[58] Field of Search ..... 192/149; 100/53, 282; 188/321

[56] References Cited

U.S. PATENT DOCUMENTS

| | | | |
|---|---|---|---|
| 2,238,538 | 4/1941 | Munschauer | 192/149 |
| 3,367,460 | 2/1968 | Wanner | 192/149 |

*Primary Examiner*—Billy J. Wilhite

*Attorney, Agent, or Firm*—Holman & Stern

[57] ABSTRACT

An anti-overrun device for the slide in a press comprising a rotary member secured to a crankshaft and having a lateral projection extending from the side of the rotary member, a cylinder secured to the framework of the press and receiving a piston for slidable movement therein, a pin supported by the piston for movement toward and away from the projection on the rotary member, an oil pressure chamber defined between one wall of the cylinder and the inner end of the piston to produce an oil pressure as the piston slidably moves within the cylinder, and a plurality of orifices formed in the side wall of the oil pressure chamber and adapted to be in turn closed as the piston slidably moves within the cylinder.

2 Claims, 5 Drawing Figures

ANTI-OVERRUN DEVICE FOR THE SLIDE IN A PRESS

BACKGROUND OF THE INVENTION

This invention relates to a device for preventing the slide in a press from descending twice (overrun) in one cycle of processing operation on a work in such a press.

Hithertofore, attempts have been made for preventing the slide from descending twice (overrun) in a single cycle of processing operation on a work in a press having a friction clutch by an electric interlocking mechanism. However, prevention of such twice-descending or overrun of the slide could not be satisfactorily attained because of any electric trouble in the electric circuit of the press and any mechanical trouble in the rotary cam limit switch associated with the press.

SUMMARY OF THE INVENTION

Therefore, an object of the present invention is to provide an anti-overrun device which is adapted to precisely stop the operation of a press after a single cycle of processing operation on a work in the press independently or in cooperation with the above-mentioned interlocking mechanism and ultimately by means of mechanical means.

The present invention will now be described on the assumption that the device of the present invention is operated when the press operates in "Safety - one stroke" mode, but the invention is not limited to such application.

The above and other objects and attendant advantages of the present invention will be more apparent to those skilled in the art from a reading of the following detailed description in conjunction with the accompanying drawings which show one preferred embodiment of the invention for illustration purposes only, but not for limiting the scope of the same in any way.

BRIEF DESCRIPTION OF THE DRAWINGS

FIG. 3 is a top plan view of FIG. 2;

PREFERRED EMBODIMENT OF THE INVENTION

Figure 1:
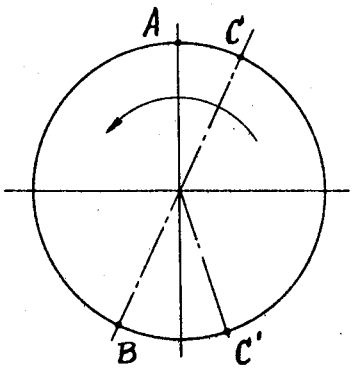
FIG. 1 is an explanative view showing the angular positions which the crank in a press assumes as the crank rotates.

Referring to FIG. 1, when the crank is positioned at Point A, the manual push button is depressed to actuate the press which in turn shifts the clutch to its "ON" position whereupon the crank initiates its rotation. At this time, however, the clutch tends to shift to its "OFF" position to interrupt the rotation of the crank unless the push button is continuously depressed until the crank rotates to Point B. After having passed Point B, the crank is allowed to continuously rotate to Point C because the clutch is maintained in its "ON" position by an electrical device even if the push button is released from the manual depressing force applied thereto. When the crank has rotated to Point C, the rotary cam limit switch interlocked with the crank operates to provide a "Clutch Off" signal to operate the brake which in turn stops the rotation of the crank at Point A. At such a time, reactuation of the crank is prevented even if the push button is maintained in its depressed state. (The crank is prevented from reactuating because the crank is electrically interlocked by a signal from the rotary cam limit switch).

In the above-mentioned "Safety - one stroke" mode operation, the crank is maintained at the upper dead point for a predetermined time period after the crank has completed one rotation for a cycle operation in the press so that a next work to be processed can be fed into the press and thereafter, a cycle of processing operation is performed on the work in the press. However, there is the case in which the rotary cam limit switch and/or the brake fail to operate due to any trouble and other causes when the crank has reached Point C and the crank further continues its rotation beyond Point A whereby the slide descends twice (overrun) during one complete rotation of the crank resulting in damage to the pattern and/or press and personal hazards.

The present invention provides a device which eliminates the disadvantages referred to hereinabove and satisfactorily prevents such twice-descending of the slide (overrun).

Figure 2:
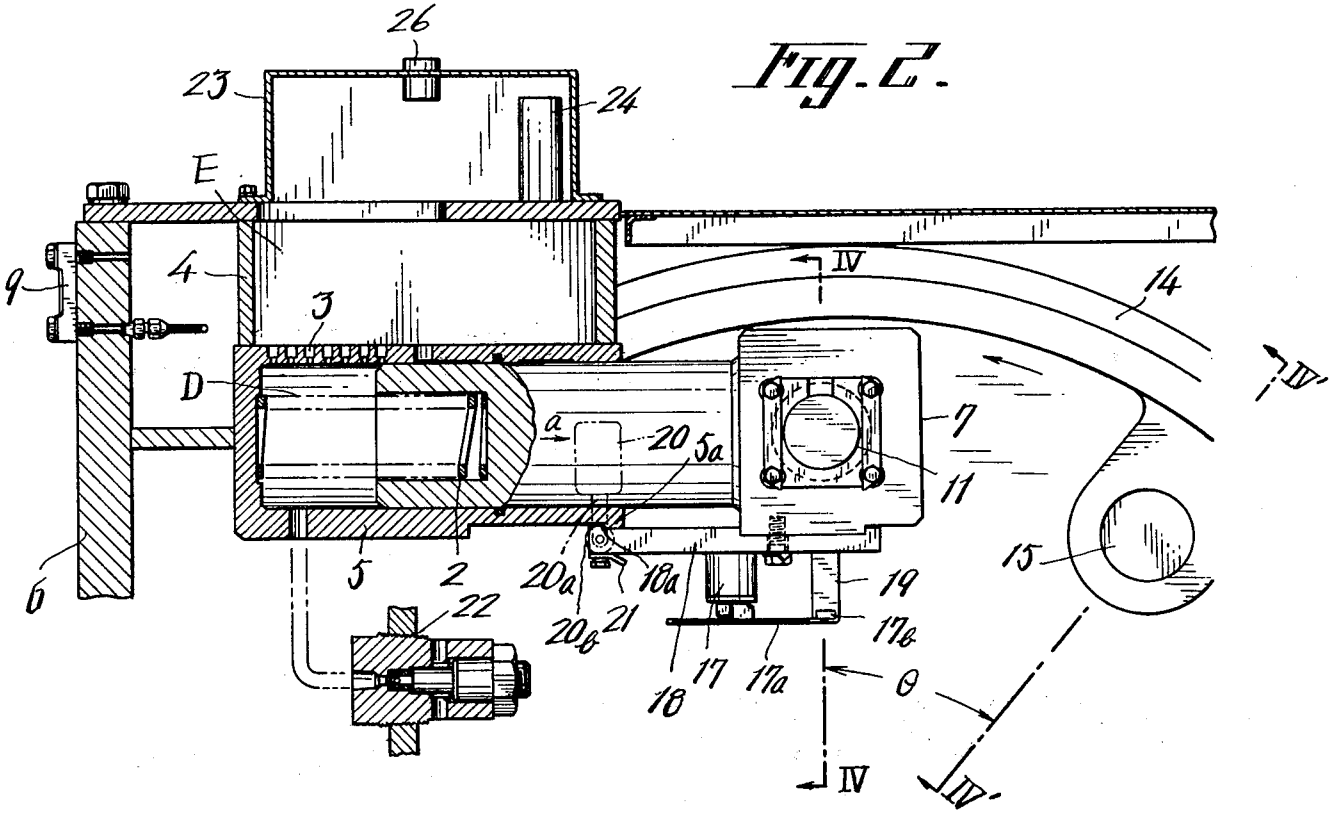
FIG. 2 is a fragmentary vertically sectional view taken along line II—II of FIG. 3 showing a portion of one preferred an anti-overrun device for the slide in the press constructed in accordance with the present invention.
Figure 7:
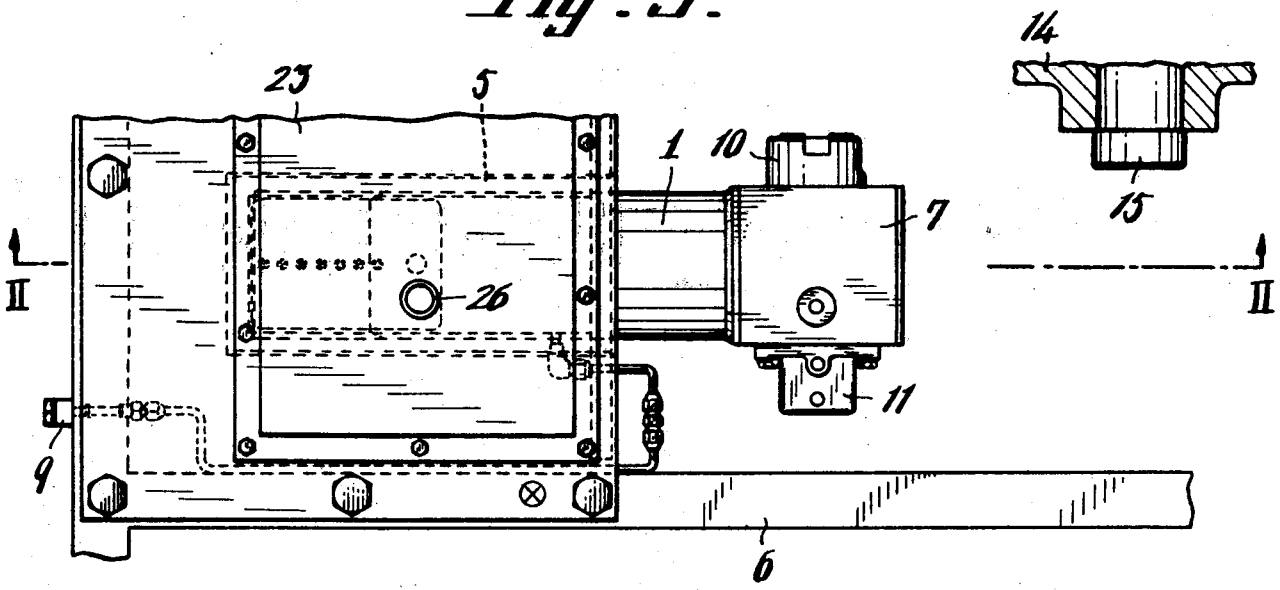
Figure 4:
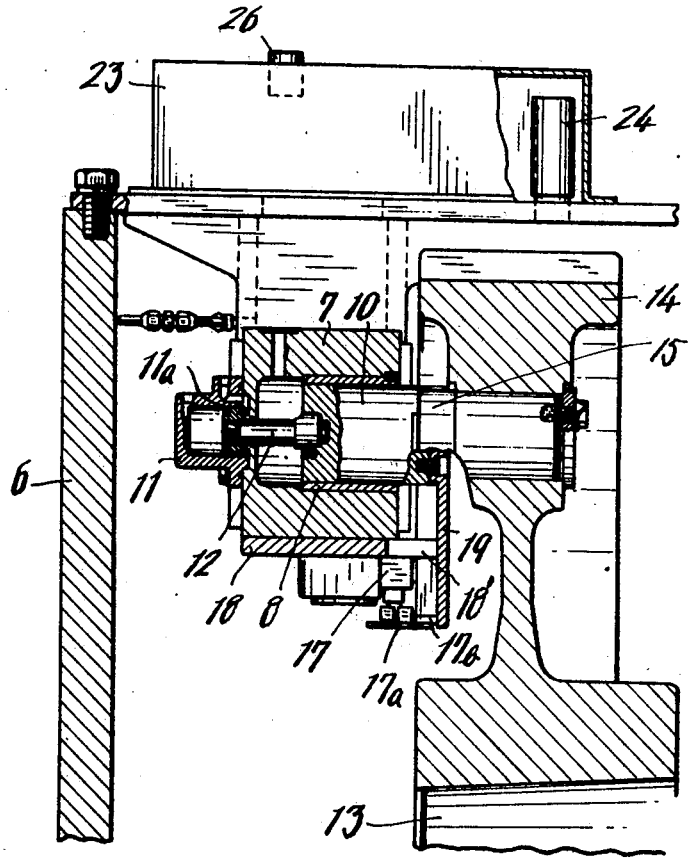
FIG. 4 is a cross-sectional view taken along lines IV—IV and IV'—IV' of FIG. 2, respectively.

One preferred embodiment of the present invention will now be described with reference to FIGS. 2 through 5 and particularly, to FIG. 2. As shown in FIG. 2, a cylinder 5 which is closed at one end is fixedly secured to the framework 6 of the press in a horizontal disposition and receives a piston 1 for slidable movement therein. The bottom wall of the cylinder 5 and the inner end of the piston 1 define an oil pressure chamber D therebetween and the upper wall portion of the cylinder 5 defining the oil pressure chamber D is provided with a plurality of spaced orifices 3 arranged in the displacement direction of the piston 1. The orifices 3 communicate between the oil pressure chamber D and the hollow interior or tank chamber E of an oil tank 4 disposed above the cylinder 5. The outer end or right-hand end (FIG. 2) of the piston 1 has a hollow block 7 integrally connected thereto. A damper pin 10 (FIG. 4) is received in the hollow interior of the block with a bushing 8 interposed therebetween for slidable movement within the block 7 at right angles to the piston 1. The outer or right-hand end of the damper pin 10 (FIG. 4) extends toward a rotary member such as a main gear 14 which is secured to a crankshaft 13 (FIG. 4). The other or inner end of the damper pin 10 is connected to a piston rod 12 of a piston 11*a* slidably received within an air cylinder 11 which is in turn secured to the hollow block 7.

The rotary member 14 has a stopper pin 15 secured to the outer periphery of the rotary member in opposition to the above-mentioned damper pin 10 and the leading end of the stopper pin 15 extends toward the damper pin 10. The damper pin 10 has a projection at one or the right-hand end (FIG. 4) to which a plate 19 is secured and the plate 19 is adapted to move through a slot 18' formed in a stopper plate 18 which is in turn secured to the hollow block 7. The stopper plate 18 has a limit switch 17 (the switch is a lever type) secured thereto and a lever 17*a* has a roller 17*b* at the leading end to engage the plate 19 so as to operate the limit switch 17. The purpose of the limit switch 17 is to determine whether the damper pin 10 is moving properly or not and the switch 17 is operatively connected to the press actuation push button (not shown) through an electric circuit.

In FIG. 2, a spring 2 acts on the piston 1 to urge both the piston 1 and hollow block 7 in the direction of arrow a. The shoulder 18*a* formed on the stopper plate 18 abuts against the mating shoulder 5*a* on the cylinder 5 to thereby hold the piston 1 in its extended position.

As shown in FIG. 2, a cam plate 21 is secured to the stopper plate 18 and a roller 20*b* at the leading end of an operation rod 20*a* for a limit switch 20 is secured to the cylinder 5. The limit switch 20 is designed to shift to its "ON" position so as to break the overall operation electric circuit for the anti-overrun device leading to the power source when the piston 1 has retracted into the cylinder 5 while the device is operating. An oil pressure adjusting valve 22 is connected to the cylinder 5 through an oil pressure conduit to limit the oil pressure within the oil pressure chamber D of the cylinder 5 to a predetermined maximum value.

As shown in FIG. 2, an oil head gauge 9 is attached to the oil tank 4 and the top of the oil tank 4 is covered by a cover member 23 to prevent scattering of the oil in all directions and also to buffer the oil pressure within the oil tank 4. The oil within the cover member 23 is released through a pipe 24 into the machine body of the press for reuse. Oil may be added through pipe 26.

The operation of the anti-overrun device of the invention will now be described.

Figure 5:
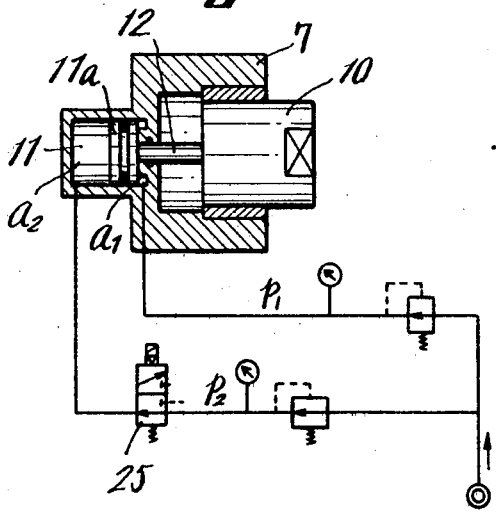
FIG. 5 is a schematic view of the pressurized air circuit in the press.

Referring to FIG. 5, in operation, a low air pressure $P_1$ acts on chamber $a_1$ of the air cylinder 11 and a high air pressure $P_2$ acts on chamber $a_2$ of the cylinder 11. An electromagnetic valve 25 is provided in the air pressure circuit and designed to be in the "ON" position when the press actuation push button is in its "ON" position so as to evacuate the chamber $a_2$ of the air cylinder 11 and to supply air to the chamber $a_1$ of the cylinder 11 in response to a signal from the rotary cam limit switch.

When the crank is held at the upper dead point, the electromagnetic valve 25 is in its "OFF" position to supply air to the chamber $a_2$ of the cylinder 11 and the air pressure of $P_2$ minus $P_1$ urges the piston 11*a* of the cylinder 11 so as to push the outer end of the damper pin 10 out of the hollow block 7.

When the press actuation push button is shifted to its "ON" position, the electromagnetic valve 25 is also shifted to its "ON" position to release the air pressure from the chamber $a_2$ of the air cylinder 11 and the piston 11*a* is urged by the air pressure $P_1$ which normally acts on the chamber $a_1$ so as to retract the damper pin 10 into the block 7. At this time, the limit switch 17 is shifted to its "ON" position as the result of the lever 17*a* being pushed by the plate 19. From this time on, the damper pin 10 continues to maintain its retracted position until the crank reaches Point C' as seen in FIG. 1 whereupon the electromagnetic valve 25 is shifted to its "OFF" position in response to a signal from the rotary cam limit switch and piston 11*a* is urged by the air pressure of $P_2$ minus $P_1$ so as to push the pin 10 out of the block 7.

When the operation of the press terminates with the crank positioned at the upper dead point or Point A as seen in FIG. 1, the damper pin 10 assumes the position pushed out of the block 7 at an angle $\theta$ to the stopper pin 15 (FIG. 2) and maintains this position until the press actuation push button is depressed for the next processing operation cycle of the press. When the damper pin 10 remains within the block 7 even if the rotary cam limit switch has provided a signal with the crank positioned in at Point C', reactuation of the crank is electrically prevented since the limit switch 17 is in its "ON" position.

The damper pin 10 effects one reciprocal movement per stroke movement of the slide and the reciprocal movement of the damper pin 10 is confirmed by the limit switch 17. When any abnormal condition is found in the movement of the damper pin 10, even if the push button is depressed the clutch can not be shifted to its "ON" position and as a result, the crank is prevented from actuating again. In order to check the damper pin 10 at the start of operation of the press, the limit switch 17 confirms the pushed-out state of the damper pin 10 to make it possible to energize the main motor (not shown) which rotates the crank.

In a press, when any abnormal condition occurs on the clutch and/or brake, even if the limit switch has provided a clutch "OFF" signal with the crank positioned at Point C as seen in FIG. 1, the twice-descending or overrun of the slide takes place under the conditions as will be described hereinbelow.

(1) The clutch actuation electromagnetic valve breaks down and as a result, the clutch remains in its "ON" position.

(2) Even if air pressure for actuating the clutch has been discharged, foreign matter entrapped in the clutch maintain the clutch in its "ON" position.

(3) Even if the clutch is disengaged, the brake fails to operate.

When the crank continues to rotate under the conditions enumerated hereinabove, the stopper pin 15 strikes against the damper pin 10 to push the piston 1 which in turn discharges the oil within the oil pressure chamber D through the orifices 3 into the tank chamber E of the oil tank 4.

At this time, the oil pressure generated within the oil pressure chamber D increases by the resistance offered by the orifices 3 against the flow of the oil and the resistance applied against the piston 1 increases to absorb inertia energy of the press to thereby stop the press.

Since the inertia energy of the flywheel in a press is usually great, it is difficult to absorb the inertia energy of the press including that of the flywheel. Of the abnormal conditions enumerated hereinabove, the abnormal condition (3) can be easily eliminated. However, under the abnormal conditions (1) and (2), it is necessary that the value of the reaction force generated by the above-mentioned oil pressure corresponding to the force applied to the pin 10 be increased, the clutch be caused to slip and the force applied to the flywheel be interrupted. The overall effective area of the orifices 3 decreases gradually as the orifices 3 are in turn closed when the piston 1 moves within the cylinder 5 in one stroke movement while increasing the reaction force correspondingly. At this time, since the clutch slips, the flywheel is decelerated. At this time, the main motor is, of course, rendered into its deenergized position by a signal from the limit switch 20.

Operative effects of the present invention will now be described hereinbelow.

(1) Since the damper pin 10 is operated per stroke movement of the press slide in response to the operation of the press, no extra abnormal condition (overrunning) detection device is necessary. Since the operation of the damper pin 10 is checked per stroke movement of the slide and reactuation of the press is prevented whenever any abnormal condition occurs in the operation of the damper pin 10, the anti-overrun device has high safe and reliable characteristics.

(2) Since the resistance offered by the orifices 3 against the flow of oil produces an oil pressure which acts as a damper, no extra oil pressure producing device is necessary.

(3) Since the plurality of orifices 3 are arranged in the stroke movement direction of the piston 1 and the number of the open orifices is gradually reduced as the piston 1 effects its stroke movement, the following advantages can be obtained:

(a) Even if the number of strokes of the slide per minute varies, since a predetermined damping oil pressure is generated and the produced oil pressure is maintained, the inertia force can be positively absorbed.

(b) When the causes of the above-mentioned twice-descend or overrun of the slide are present, and more particularly, when the clutch torque is transmitted to the crankshaft, since the oil pressure generated through the resistance offered by the orifice or orifices against the flow of oil is generally in proportion to the square of the flow velocity of oil, when the clutch torque is transmitted to the crankshaft, if the effective area or cross-sectional area of the orifice or orifices remains unchanged as the piston 1 effects its stroke movement, the damping action by the orifice or orifices is not effective when the movement speed of the piston 1 decreases. On the other hand, in order to decrease the flow velocity of oil pressure, when the effective area or cross-sectional area of the orifice or orifices is reduced, a high oil pressure (peak pressure) generated at the initial stage of the damping action and in consequence, the impact is high. According to the present invention, since the gross effective area of the orifices 3 is gradually decreased as the piston 1 effects its stroke movement, even if the piston 1 moves at a relatively low speed, an oil pressure which can overcome the clutch torque generated and in consequence, even when the clutch torque is transmitted to the crankshaft, the press can be positively decelerated whereby the press can be stopped by a low impact and the impact at the initial stage of the damping action is relatively low.

(4) By the provision of the oil pressure regulation valve in the oil pressure chamber D, generation of any excessive pressure is eliminated when the stroke number of the slide per minute is great.

(5) Since the damper pin 10 is directly attached to the piston 1 and operated at right angles to the piston 1, the overall size of the anti-overrun device can be reduced to a degree that the device can be mounted within a gear box and can be incorporated in a small size press.

While only one embodiment of the invention has been shown and described in detail it will be understood that the same is for illustration purposes only and not to be taken as a definition of the invention, reference being had for this purpose to the appended claims.

What is claimed is:

1. An anti-overrun device for a slide in a press comprising: a crankshaft; a rotary member secured to the crankshaft; a projection extending from the side of the rotary member; a cylinder adapted to be secured to a framework of a press; a piston slidably received within the cylinder; a pin supported by the piston for movement into and out of a circle described by the rotation of the projection extending from the rotary member; control means connected to the pin to control movement of the pin into and out of the circle described by the rotation of the projection on the rotary member and to control actuation of the press, whereby the control means prevents reactivation of the press when the projection strikes against the pin; an oil pressure chamber defined in the cylinder to produce an oil pressure therein as the piston slidably moves within the cylinder; and a plurality of orifices formed in the side wall of the oil pressure chamber to be closed in turn as the piston slidably moves within the cylinder.

2. The anti-overrun device for a slide in a press as set forth in claim 1, wherein the control means comprises: an air cylinder connected to the pin for moving the pin into and out of the circle described by the rotation of the projection extending from the rotary member; a stopper plate having a slot connected to the cylinder; a plate secured to the pin and adapted to move through the slot in the stopper plate; and a limit switch secured to the stopper plate and adapted to engage the plate and to control actuation of the press.

* * * * *